US007585822B2

(12) United States Patent
Costello et al.

(10) Patent No.: US 7,585,822 B2
(45) Date of Patent: Sep. 8, 2009

(54) EMULSIFIER BLENDS FOR LUBRICATING OILS

(75) Inventors: Michael T. Costello, Southington, CT (US); Zhaopeng Li, Vaughan (CA); Ronald J. Muir, West Hill (CA); Igor Riff, Waterbury, CT (US); Joseph A. Weaver, Jr., Torrington, CT (US)

(73) Assignee: Crompton Corporation, Middlebury, CT (US)

( * ) Notice: Subject to any disclaimer, the term of this patent is extended or adjusted under 35 U.S.C. 154(b) by 713 days.

(21) Appl. No.: 10/996,273

(22) Filed: Nov. 23, 2004

(65) Prior Publication Data

US 2006/0111252 A1 May 25, 2006

(51) Int. Cl.

| | |
|---|---|
| ***C07C 309/62*** | (2006.01) |
| ***C10M 129/54*** | (2006.01) |
| ***C07C 51/15*** | (2006.01) |
| ***C09K 3/00*** | (2006.01) |

(52) U.S. Cl. ..... 508/390; 508/518; 516/53

(58) Field of Classification Search ..... 508/390, 508/518; 516/53

See application file for complete search history.

(56) References Cited

U.S. PATENT DOCUMENTS

| | | | | |
|---|---|---|---|---|
| 2,606,872 | A | 8/1952 | Gasser et al. | |
| 2,907,714 | A | 10/1959 | Francis et al. | |
| 3,458,449 | A | 7/1969 | Mausner et al. | |
| 4,140,642 | A | 2/1979 | Kistler et al. | |
| 4,419,252 | A | 12/1983 | Shim | |
| 5,415,792 | A | 5/1995 | Campbell | |
| 5,734,078 | A * | 3/1998 | Feilden et al. | 562/477 |
| 6,140,282 | A | 10/2000 | Cartwright et al. | |
| 6,191,081 | B1 | 2/2001 | Cartwright et al. | |
| 6,225,267 | B1 | 5/2001 | Eckard et al. | |
| 6,511,946 | B1 | 1/2003 | Theis et al. | |
| 2003/0069145 | A1 * | 4/2003 | Chambard et al. | 508/460 |
| 2003/0220205 | A1 * | 11/2003 | Manka et al. | 508/154 |
| 2004/0097750 | A1 * | 5/2004 | Muir | 560/71 |

* cited by examiner

*Primary Examiner*—Walter D Griffin
*Assistant Examiner*—Frank C Campanell
(74) *Attorney, Agent, or Firm*—Jaimes Sher

(57) ABSTRACT

An emulsifier blend includes at least one alkali metal sulfonate and at least one alkali metal alkyl salicylate. The emulsifier blend can be combined with a lubricant oil to provide a water-miscible lubricating oil concentrate capable of forming a stable aqueous emulsion when added to an aqueous medium.

7 Claims, No Drawings

EMULSIFIER BLENDS FOR LUBRICATING OILS

FIELD OF THE INVENTION

This invention relates to emulsifier blends for preparing water-miscible concentrates of lubricating oils, to such concentrates and to aqueous emulsions obtainable therefrom.

BACKGROUND OF THE INVENTION

Alkali metal sulfonates include natural petroleum sulfonates, e.g., sodium petroleum sulfonates and synthetic petroleum sulfonates made by the sulfonation of alkyl aromatic compounds. Alkali metal sulfonates are widely used as the primary emulsifier in formulating emulsifiable lubricating compositions used for cutting fluid, hydraulic fluids, metal-working lubricants, and so forth.

Sodium petroleum sulfonates are typically produced as a by-product of refining processes in which certain highly refined petroleum products such as white lubricating oils, medicinal oils, and certain grades of transformer oils, are produced. The highly refined petroleum products are produced by treating a refined petroleum distillate or raffinate with fuming sulfuric acid which reacts with certain components of the oil to produce sulfonic acids, some of which are oil-soluble and some of which are water-soluble, thus forming a two-phase system. The two phases separate into two layers one of which is the oil layer containing the oil-soluble reddish-brown or mahogany sulfonic acids, and one of which is the water-soluble layer commonly referred to as an acid sludge layer that contains resinous materials, unreacted sulfuric acid, and water-soluble or green sulfonic acids. The layers are then separated and the oil-soluble sulfonic acids recovered from the oil layer, usually in the form of their sodium salts.

The mahogany sulfonic acids being preferentially oil-soluble have found wide use in the preparation of emulsifiable petroleum products, such as in soluble cutting oils, hydraulic fluids, metalworking lubricating fluids for forming of metals, and so forth. The acid oil layer is neutralized to make a sodium salt and extracted with a polar solvent, typically alcohol, to separate most of the oil phase, and to increase the activity of the sodium sulfonate. This type of process is discussed generally in U.S. Pat. No. 1,930,488. The manufacture of white oils by the above process has become increasingly uneconomical and as a result, the production of sulfonates as by-products of white oil refining is substantially declining. This has left a significant shortage of sodium petroleum sulfonates.

To cope with this shortage of sodium petroleum sulfonates, applicants have investigated a variety of emulsifier candidates as replacements for some significant portion of the sulfonate emulsifier employed in the manufacture of emulsifiable concentrates of lubricating oils. As a result of these investigations, it has been found that alkali metal alkyl salicylates can substitute for equal weight amounts of alkali metal sulfonates in otherwise known and conventional sodium sulfonate emulsifier compositions intended for use in the production of water-miscible lubricating oil concentrates while achieving similar emulsion-forming properties as the all-sulfonate emulsifier compositions.

SUMMARY OF THE INVENTION

In accordance with present invention, there is provided a blend of emulsifiers for use in the production of a water-miscible lubricating and composition comprising:

a) at least one alkali metal sulfonate emulsifier; and, b) at least one alkali metal alkyl salicylate emulsifier.

Further, in accordance with the present invention, there is provided a water-miscible lubricating oil concentrate which comprises:

a) at least one oil of lubricating viscosity; and, b) a blend of emulsifiers in admixture with the oil in an amount sufficient to provide a stable aqueous emulsion upon the addition of an aqueous medium thereto, the blend of emulsifiers comprising:

(i) at least one alkali metal sulfonate emulsifier; and, (ii) at least one alkali metal alkyl salicylate emulsifier.

DESCRIPTION OF THE PREFERRED EMBODIMENTS

The alkali metal sulfonate emulsifier component of the emulsifier blends herein can be one or a mixture of any of such emulsifiers heretofore used in the manufacture of water-miscible lubricating oil concentrates. By "alkali metal" is meant one or more elements of Group 1A of the Periodic Table of the Elements including lithium, sodium and potassium. Sodium is especially preferred. The preferred alkali metal sulfonates are the sodium petroleum sulfonates, e.g., as described above, or those obtained by sulfonating aryl compounds such as those of benzene, toluene, xylenes, ethyl benzenes, etc., alkylated with long chain olefinic alkylating agents. Mixtures of these and similarly useful alkali metal sulfonate emulsifiers can be used, e.g., as described in U.S. Pat. No. 6,225,267, the contents of which are incorporated by reference and form an integral part of this application.

More particularly, the first component of the inventive composition are natural petroleum sulfonates or sulfonic acid salts prepared using sulfuric acid, oleum, (i.e. fuming sulfuric acid) and/or sulfur trioxide or other sulfonating agent to sulfonate petroleum oil, preferably a paraffinic oil. A preferred oil for use herein is a typical lube base oil of 15-4000 cSt @ 40° C. The acid oil is desludged by settling using natural gravitational forces, and is subsequently neutralized to about a 15-30%, preferably about 20-30% active petroleum sulfonate in oil. No further extraction or processing for the removal of oil or salts is conducted. These sulfonates will be hereinafter referred to as non-extracted sulfonates to distinguish them from the natural sulfonates that are prepared as a by-product of a refining process. These non-extracted natural sulfonates, as neutral salts, provide corrosion protection properties to metal, and assist in emulsification performance. Other extracted sulfonates may be added to the present invention in combination with the non-extracted sulfonates of the present invention. The petroleum sulfonates used as the first component of the present invention are very economical to produce due to the minimum amount of processing required. The preferred paraffinic oil feed stream is low cost and in abundant supply. The sulfonates can be blended with other sulfonate emulsifiers to produce a product of preferably 60% or greater active content, for instance with highly active sulfonic acids. An example of a natural sodium petroleum sulfonate of this type is Sodium petroleum sulfonate, MNT, a 30% active sulfonic acid salt supplied by CK Witco in Greenwich, Conn. In the previous method of preparing concentrated petroleum sulfonate emulsifiers, a separation/extraction process is used to prepare the final product. Using these methods, oleum or sulfur trioxide is added to the petroleum oil to remove the aromatics, and to produce USP white oils or special naphthenic process oils. After the acid treatment, the spent acid and low equivalent weight sulfonic acids, i.e. sludge acids, are separated from the oil soluble acids. The later material is then neutralized to make a sodium salt and is extracted with a polar solvent(s), typically lower alcohols, to separate most of the oil and increase the activity of the sodium sulfonate.

The emulsifier compositions of the present invention can also comprise a branched alkylaryl sulfonate. Branched structures have been known to exhibit improved solubility and emulsion stability. Branched chain alkylaryl sulfonates are discussed in U.S. Pat. No. 4,140,642 incorporated herein by reference in its entirety. Aryl groups include benzene, toluene, naphthalene, xylene, and so forth.

These alkylaryl sulfonates may be prepared using standard sulfonation techniques which typically involve sulfonation of the appropriate of aromatic hydrocarbons, thereby obtaining the alkylaryl sulfonic acids which are then subsequently neutralized with a base.

The alkylation may be carried out using any method known to one of skill in the art including a Friedel-Crafts reaction using an alkyl halide, alkanol, or alkene reactant in the presence of a Lewis acid catalyst. Catalysts may include hydrogen fluoride and activated clay.

The sulfonation is then carried out typically by contacting the alkylated aromatic compound with concentrated sulfuric acid and/or sulfur trioxide ($SO_3$). The sulfonic acid may then be neutralized with a base, preferably an alkali metal base such as lithium, sodium or potassium hydroxide, and especially sodium hydroxide.

The alkali metal alkyl salicylate emulsifier component of the emulsifier blends herein can be selected from amongst one or more of the many known alkyl-substituted salicylate alkali metal salts known in the art. In general, such salicylates are obtained by known and conventional processes, e.g., as described in U.S. Pat. No. 5,734,078. The alkyl substituent(s) can contain from about 5 to about 100, preferably from about 9 to about 30 and more preferably from about 14 to about 20 carbon atoms. Where there are more than one alkyl group, the average number of carbon atoms in all of the alkyl groups is preferably at least about 9 to ensure adequate compatibility when added to lubricating oil.

The proportions of sulfonate and salicylate emulsifiers present in the blends can vary widely. In general, the emulsifier blend prepared in accordance with this invention can contain from about 35 to about 95, preferably from about 40 to about 85, and more preferably from about 40 to about 60, weight percent sulfonate emulsifier(s), the remainder of the emulsifier blend being made up of the salicylate emulsifier(s).

To prepare a water-miscible lubricating oil concentrate, a sufficient amount of emulsifier blend as described above is substantially uniformly admixed with a quantity of lubricating oil ("base oil") such that upon addition of an aqueous medium thereto a stable oil-in-water emulsion will result.

Preferred lubricating oils have a kinematic viscosity in the range of from 1 to about 1,000 cSt at a temperature of 40° C. Suitable lubricating oils include mineral oils and synthetic oils. Examples of mineral oils include a distilled oil which can be obtained by distilling a paraffinic crude oil, an intermediate crude oil or a naphthenic crude oil under atmospheric pressure, or by distilling, under reduced pressure, a residual oil at the time of distillation under atmospheric pressure, and a refined oil obtained by refining this distilled oil. Examples of the refined oil include a solvent-refined oil, a hydrogenation-refined oil, a dewaxed oil and a clay-treated oil. Examples of synthetic oils include a low-molecular weight polybutene, a low-molecular weight polypropylene, oligomers of alpha-olefins having 8 to 14 carbon atoms, alkylbenzenes, and alkylnaphthalenes. These mineral oils and synthetic oils can be used singly or in a combination of two or more thereof.

It is preferred that the lubricating oil contain from about 20 percent to about 60 percent by weight of a highly refined base oil having a kinematic viscosity of from about 30 to about 800 cSt at a temperature of 40° C., for example, a mineral oil having a sulfur content of about 500 ppm or less, preferably about 100 ppm or less, treated by a hydrogenation-refining process and/or a (co)polymer of an olefin, because the employment of the highly refined base oil tends to inhibit the generation of stains and rust on worked articles.

The amount of emulsifier blend to be added to a given weight of lubricating oil will, of course, depend on the nature of the emulsifier blend, the nature of the lubricating oil and other factors as those skilled in the art will readily appreciate. Optimum amounts of a particular emulsifier blend and a particular lubricating oil can be determined employing routine testing methods. In general, a lubricating oil concentrate in accordance with this invention can contain from 1 to about 50, preferably from 2 to about 30, and more preferably from about 5 to about 20, weight percent of emulsifier blend herein. The lubricating oil, in addition to the emulsifier blend, can contain up to about 10 weight percent fatty acid soap(s), up to about 10 weight percent extreme pressure lubricating agent(s), up to about 5 weight percent anti-corrosion agent(s) and up to 3 weight percent of one or more biostatic and/or biocidal agents.

The water-miscible lubricating oil concentrate herein upon addition to an aqueous medium, usually water, forms a stable aqueous emulsion suitable for a variety of applications, metalworking principally amongst them. Aqueous emulsions of the oil-in-water and water-in-oil type can be formed with the addition of from about 1 to about 40, preferably from about 2 to about 30 and more preferably from about 5 to about 20 weight parts of lubricating oil concentrate herein per 100 weight parts of water.

The sulfonate component of the emulsifier blend of the invention is preferably one or more alkali metal petroleum sulfonate, preferably sodium salts of petroleum based sulfonic acid. Such sulfonates are commercially available. Examples of suitable sulfonates include: Petronate® HH, a high molecular weight (550 EW) sodium petroleum sulfonate; Petronate® NNH, a high molecular weight (550 EW) blend of sodium synthetic and petroleum sulfonate; Petronate® L, a low molecular weight (430 EW) sodium petroleum sulfonate; Petronate® HLI, a medium molecular weight (460 EW) sodium petroleum sulfonate; Petronate® HMW, a high molecular weight (550 EW) sodium petroleum sulfonate; Synacto® 246, a sodium salt of a branched dodecylxylene sulfonate having an equivalent weight of about 520; and Penreco® M-60, a medium molecular weight (480 EW) sodium petroleum sulfonate.

The salicylate component of the emulsifier blend of the invention is an alkali metal alkyl salicylate, preferably a sodium alkyl salicylate, wherein the alkyl group contains from about 6 to about 36 carbon atoms, preferably from about 8 to about 24 carbon atoms, more preferably from about 14 to about 18 carbon atoms.

A water-miscible lubricant composition can include, in addition to lubricant base oil and the emulsifier blend of the invention, various other components such as alkyl sulfonic acids, alkylene glycols, water, and alkali hydroxide.

The following examples illustrate the invention. The comparative examples are presented for comparison purposes only and do not illustrate the invention. Testing was performed in accordance with the following procedures.

Emulsion Test

10 Grams of emulsifier and 90 grams of white mineral oil (70 SUS) were combined and warmed on a hot plate until completely dissolved. Then, 10 ml of the blend were added to 90 ml of distilled water in a graduated cylinder and shaken vigorously for 60 seconds. After one hour settling the emulsion characteristics were recorded as follows:

Good: completely emulsified milky appearance, some cream at the top, <10 ml of cream.

Fair: completely emulsified slightly watered down milk appearance, some cream at the top, <10 ml of cream.

Poor: emulsion water layer appears as watered down milk, >10 ml of cream.

Negative: does not emulsify, oil immediately rises to the top.

Good or Fair results are considered acceptable emulsion performance.

Rust Test

If the emulsion displayed fair to good performance the rust test was performed. Performing a rust test on a negative emulsion can yield unreliable results. The procedure used was similar to the ASTM D4627 method with several modifications. The details are as follows:

a. The emulsion tested was a 95/5 D.I water/soluble oil base blend, of which the soluble oil base was composed of an 80/20 white oil/emulsifier blend.

b. The test was conducted using 2.0 g of steel chips placed in a 10 mm×35 mm plastic petri dish.

c. The emulsion was poured over the steel chips to completely immerse the chips and fill the petri dish (5-10 ml).

d. The emulsion was left to stand in the petri dish for 20 minutes and then drained by gentle shaking to remove excess liquid from the steel chips.

e. The steel chips were then left over night (16-24 hours) uncovered in the petri dish and evaluated as either passing (no rust) or failing (rust). In rare cases, only a few chips were rusted, in which case the chips were counted. If there were less than 10 rusted chips this was recorded as a marginal pass (no rust).

EXAMPLES 1-6

The following sodium alkyl salicylate salts were tested.

| Designation | Composition |
|---|---|
| SAS-1 | monoalkyl (linear $C_{12}$) salicylate, sodium salt (59% active) |
| SAS-2 | monoalkyl (linear $C_{20}$-$C_{24}$) salicylate, sodium salt (60% active) |
| SAS-3 | dialkyl (linear $C_9$) salicylate, sodium salt (52% active) |
| SAS-4 | monoalkyl (linear $C_{14}$-$C_{18}$) salicylate, sodium salt (63.6% active) |

The sodium alkyl salicylate was individually blended with selected petroleum sulfonate salts Petronate HH, Petronate L and Petronate HLI. The composition percentages are set forth in Table 1 below, along with the test results. As can be seen, the use of SAS-4 with Petronate HH provided fair results. All other combinations were poor or failed to produce an emulsion ("negative").

TABLE 1

(Composition percentages by weight)

| | Example | | | | | |
|---|---|---|---|---|---|---|
| | 1 | 2 | 3 | 4 | 5 | 6 |
| SAS-1 | 60 | | | | | |
| SAS-2 | | 60 | | | 40 | 40 |
| SAS-3 | | | 60 | | | |
| SAS-4 | | | | 60 | | |
| Petronate ® HH | 40 | 40 | 40 | 40 | | |
| Petronate ® L | | | | | 60 | |
| Petronate ® HLI | | | | | | 60 |
| Emulsion Results | Poor | Negative | Negative | Fair | Negative | Poor |

COMPARATIVE EXAMPLES A-G

Emulsifier compositions were tested in accordance with the same method as Examples 1-6. However, the emulsifier composition contained only alkyl salicylate sodium salts. In comparative Examples A to D, the sodium alkyl salicylates SAS-1, 2, 3, 4 were tested alone. See Table 2 below. All produced no emulsion, indicating that the sodium alkyl salicylate can be used to extend a sodium sulfonate, but cannot be used alone as a substitute for a sodium sulfonate, even if two sodium alkyl salicylates are combined (Comparative Examples E, F, G).

TABLE 2

(Composition percentages by weight)

| | Comp. Examples | | | | | | |
|---|---|---|---|---|---|---|---|
| | A | B | C | D | E | F | G |
| SAS-1 | 100 | | | | 50 | 75 | 25 |
| SAS-2 | | 100 | | | 50 | 25 | 75 |
| SAS-3 | | | 100 | | | | |
| SAS-4 | | | | 100 | | | |
| Petronate ® HH | | | | | | | |
| Petronate ® L | | | | | | | |
| Petronate ® HLI | | | | | | | |
| Emulsion Results | Negative | Negative | Negative | Negative | Negative | Negative | Negative |

EXAMPLES 7-12

A single sodium alkyl salicylate, SAS-4, was tested in blends with Petronate® NNH, Petronate® HH, Petronate® HLI and Penreco® M-60 for emulsion formation and for rust inhibition. The rust test was performed in accordance with the procedure outlined above. The results are set forth in Table 3. As can be seen, the best combination was with SAS-4 and Penreco® M-60, which provided an emulsifier with good emulsion results (Example 12). SAS-4 provided fair results with Petronate® HH at 60 wt % SAS-4 (Example 8), but not 80 wt % SAS-4 (Example 7). Also, SAS-4 provided fair emulsion test results when combined with both Petronate® NNH and Petronate® HLI, along with passing rust test results when the concentration of the Petronate® NNH was no more than 15%. (Example 11). However, at higher concentrations the results were negative or poor. (Examples 9 and 10).

TABLE 3

(Composition percentages by weight)

| | Example | | | | | |
|---|---|---|---|---|---|---|
| | 7 | 8 | 9 | 10 | 11 | 12 |
| SAS-4 | 80 | 60 | 10 | 12 | 15 | 25 |
| Petronate NNH | | | 20 | 18 | 15 | |
| Petronate HH | 20 | 40 | | | | |
| Petronate HLI | | | 70 | 70 | 70 | |
| Penreco M-60 | | | | | | 75 |
| Emulsion Results | Poor | Fair | Negative | Poor | Fair | Good |
| Rust Test Results | | | | | Pass | |

COMPARATIVE EXAMPLES H-K

These comparative examples were performed in accordance with the procedures of Examples 7-12 except that the composition percentage components of the component(s) of the emulsifier composition are set forth below in Table 4 along with the emulsion and rust test results. As can be seen, SAS-4 alone produced negative emulsion results although Synacto® 246 in combination with Petronate® NNH and Petronate® HLI produced fair emulsion results and a passing rust test.

TABLE 4

(Composition percentages by weight)

| | Comparative Example | | | |
|---|---|---|---|---|
| | H | I | J | K |
| SAS-4 | 100 | | | |
| Synacto ® 246 | | | 15 | |
| Petronate ® NNH | | 30 | 15 | |
| Petronate ® HH | | | | |
| Petronate ® HLI | | 70 | 70 | |
| Penreco ® M-60 | | | | 100 |
| Emulsion Results | Negative | Negative | Fair | Negative |
| Rust Test Results | | | Pass | |

EXAMPLES 13-15 and COMPARATIVE EXAMPLE L

Emulsifier blends, in addition to other selected components, were combined to formulate an additive package for lubricant oils. For Examples 13 to 15, the emulsifier blends included SAS-4 sodium alkyl salicylate along with Petronate® HH and/or Petronate® NNH. For comparative Example L, the emulsifier included Petronate® HMW and Petronate® HL, but no SAS-4.

Referring to Tables 5 and 6, the composition percentages of the components are set forth. The Emulsion results indicate whether an emulsion was achieved. The emulsion was tested for degradation by observing the emulsion over a 2-hour period and a 24-hour period for creaming. Cream volume indicates a degradation of performance.

TABLE 5

(Composition percentages by weight)

| | Example | | |
|---|---|---|---|
| | 13 | 14 | 15 |
| Emulsifier Blend | | | |
| Petronate ® HMW | | | |
| Petronate ® HL | | | |
| Petronate ® HH | 35.2 | | 17.6 |
| Petronate ® NNH | | 35.2 | 17.6 |
| SAS-4 | 35.2 | 35.2 | 35.2 |
| Other components | | | |
| Emulsifier Package A* | balance | balance | balance |
| Emulsifier Package B* | | | |
| Emulsion Results | Good | Negative | Good |
| Emulsion Degradation (2 h) (Creaming volume) | Nil | — | Nil |
| Emulsion Degradation (24 h) (Creaming Volume) | 1 ml | — | 5 ml |

*Emulsifier Packages A and B contain secondary emulsifiers and coupling agents.

TABLE 6

(Composition percentages by weight

| | Comparative Example L |
|---|---|
| Emulsifier Blend | |
| Petronate ® HMW | 5.25 |
| Petronate ® HL | 56.86 |
| Petronate ® HH | |
| Petronate ® NNH | |
| SAS-4 | |
| Other components | |
| Emulsifier Package A* | |
| Emulsifier Package B* | balance |
| Emulsion Results | good |
| Emulsion Degradation (2 h) (Creaming volume) | nil |
| Emulsion Degradation (24 h) (Creaming volume) | 1 ml |

*Emulsifier Packages A and B contain secondary emulsifiers and coupling agents.

Evaluation of Results

Referring to Table 2, all four samples of sodium alkyl salicylates (SAS-1,2,3,4) by themselves displayed negative emulsions. As a result, none of these materials can be considered as a primary emulsifier (i.e., emulsify oil with no other additives present). Referring to Table 1, the results of the blends with Petronate® HH reveal that only the SAS-4 (monoalkyl, linear $C_{14}$-$C_{18}$, salicylate, sodium salt) yielded a fair emulsion, while the other alkyl salicylates were poor or negative.

With both Petronate® L and Petronate® HLI, the emulsion performance of SAS-2 was negative and poor, respectively (see Table 1), indicating that SAS-2 is clearly a strong demulsifier.

Various blends of the high molecular weight SAS-2 and the low molecular weight SAS-1 all displayed negative emulsions (see Table 2).

Based on the preliminary evidence it appeared that the SAS-4 was the best potential candidate that could be used to make an emulsion. We attempted to reduce the amount of high molecular weight sulfonate Petronate® HH with the SAS-4, but found a poor emulsion at a 20/80 ratio (see Table 3, Example 7).

Previously, we had found that a blend of Petronate® HLI/Petronate® NNH/Synacto® 246 (70/15/15) (Table 4, Comparative Example 3) provided excellent emulsion and rust performance. In this study, we have attempted to replace the Synacto® 246 (made by Infineum) with the SAS-4 sodium alkyl salicylate. The results reveal that a blend of Petronate® HLI/Petronate® NNH/SAS-4 (70/15/15) possesses the same behavior for emulsion and rust performance as the Synacto® 246 containing blend (see Table 3, Example 11).

We also investigated extending the current medium molecular weight sulfonates, such as Penreco® M-60. Surprisingly, as shown in Example 12, a blend of Penreco® M-60/SAS-4 (75/25) displayed a good emulsion, which implies that the salicylate can be used to extend this product.

Referring to Table 5, Example 13, SAS-4 was evaluated as a potential emulsifier replacement in a soluble oil base. Since we found that a 60/40 blend of the natural Petronate® HH for high molecular weight and SAS-4 for low molecular weight displayed a good emulsion, we replaced the primary emulsifiers in the soluble oil base with a 50/50 blend of these products. We found this combination displayed the same emulsion properties as Comparative Example L, Table 6.

We also looked at formulating the salicylate with the Petronate® NNH which contains synthetic sulfonate. Contrary to the previous result, we found that Petronate® NNH and SAS-4 displayed a negative emulsion in this blend, due to the stronger demulsification properties of the Petronate® NNH (see Table 5, Example 14). We attempted to reduce the amount of Petronate® NNH by blending it with Petronate® HH (see Table 5, Example 15), but found after 24 hours, the good emulsion yielded a higher volume of cream as opposed to the combination of Petronate® HH and SAS-4 (Example 13) (5 ml vs. 1 ml). Although the emulsion was visually satisfactory, the additional cream volume indicates a degradation of performance.

While the above description contains many specifics, these specifics should not be construed as limitations of the invention, but merely as exemplifications thereof.

What is claimed is:

1. An emulsifier composition comprising a blend of:

a) from about 40 to about 85 weight percent of at least one sodium sulfonate emulsifier selected from the group consisting of sodium synthethic sulfonates, sodium petroleum sulfonates, and blends thereof; and, b) from about 15 to about 60 weight percent of at least one monoalkyl linear $C_{14}$-$C_{18}$ salicylate sodium salt.

2. The emulsifier composition of claim 1 wherein the sodium petroleum sulfonate is prepared from a lube base oil of 15-4000 cSt at 40° C.

3. The emulsifier composition of claim 1 wherein the sodium sulfonate emulsifier comprises from about 40 weight percent to about 60 weight percent of the composition with the balance being substantially comprised of the monoalkyl linear $C_{14}$-$C_{18}$ salicylate sodium salt.

4. A water-miscible oil composition comprising:

a) at least one oil of lubricating viscosity; and, b) a blend of emulsifiers in admixture with the oil in an amount sufficient to provide a stable aqueous emulsion upon the addition of an aqueous medium thereto, the blend of emulsifiers including i) from about 40 to about 85 weight percent of at least one sodium sulfonate emulsifier selected from the group consisting of sodium synthethic sulfonates, sodium petroleum sulfonates, and blends thereof; and ii) from about 15 to about 60 weight percent of at least one monoalkyl linear $C_{14}$-$C_{18}$ salicylate sodium salt.

5. The water miscible oil composition of claim 4 wherein the oil of lubricating viscosity is a petroleum distillate.

6. The water-miscible oil composition of claim 4 wherein the oil of lubricating viscosity is a synthetic oil derived from polymerized olefinic compounds.

7. The water-miscible oil composition of claim 4 wherein the sodium sulfonate comprises from about 40 weight percent to about 60 weight percent of the composition with the balance being substantially comprised of the monoalkyl linear $C_{14}$-$C_{18}$ salicylate sodium salt.

* * * * *